United States Patent [19]

Napolitano

[11] Patent Number: 4,651,373

[45] Date of Patent: Mar. 24, 1987

[54] ROOFING TOOL

[76] Inventor: Michael J. Napolitano, 29 Long Hill Rd., South Windsor, Conn. 06074

[21] Appl. No.: 825,972

[22] Filed: Feb. 4, 1986

[51] Int. Cl.[4] ..... B25F 1/00

[52] U.S. Cl. ..... 7/170; 7/105; 294/7; 294/29

[58] Field of Search ..... 7/105, 170; 294/28, 294/50.9, 29, 7, 104

[56] References Cited

U.S. PATENT DOCUMENTS

| | | | |
|---|---|---|---|
| D. 279,514 | 7/1985 | Grunz . | |
| 444,504 | 1/1891 | Penfield | 294/29 |
| 836,440 | 11/1906 | Collins | 294/7 |
| 856,446 | 6/1907 | Collins | 294/7 |
| 1,648,324 | 11/1927 | Pratt | 15/105 |
| 2,304,966 | 12/1942 | Thrower . | |
| 2,333,564 | 11/1943 | Hargrave | 294/29 |
| 2,725,740 | 12/1955 | Borgstrom . | |
| 3,464,730 | 9/1969 | Gagliardi et al. . | |
| 3,947,916 | 4/1976 | Mitchell . | |
| 4,074,917 | 2/1978 | Federico | 294/7 |
| 4,386,543 | 6/1983 | Walker, Jr. . | |

*Primary Examiner*—Roscoe V. Parker

[57] ABSTRACT

A roofing tool comprises a trowel blade and a pivotal clamping arm for use in the installation of torch-fused roofing material. A shaft is mounted to a shank which extends from the trowel blade and mounts the trowel handle. The shaft pivotally mounts the clamp arm. The clamp arm is configured so that the forward portion of the arm and the forward tip of the trowel blade cooperate to form a clamp.

9 Claims, 2 Drawing Figures

ROOFING TOOL

BACKGROUND OF THE INVENTION

1. Field of the Invention

This invention relates to tools employed for the installation of a roofing system. More particularly, the present invention relates generally to a tool which is employed in the installation of torch-fused roofing material which is applied in overlapping sheets.

2. Description of the Prior Art

A common roofing system having particular applicability for large flat roofs comprises overlapping sheets of plasticized bituminous roofing membrane. The roofing membrane may be formed from distilled asphalt polymeric resins and other petrochemicals and contains a rugged polyester core. The membrane is formed into elongated sheets which are supplied in roll form. The membrane is rolled onto the roof surface while being heated with a propane torch. Bonding and sealing is achieved by the torching of the roofing membrane, to soften the asphalt, and subsequently pressing the membrane against the roof surface to effect an adhesive bond to the roof surface. Special adhesives and sealants are ordinarily not required. The roofing membrane is sealed to itself in the regions which define overlapped seams by torching or heating the seams and troweling along the seams.

At locations where a sloped or flat roof abuts a vertically projecting side surface for example a shed dormer or other structure projecting from the roof surface, a flashing is customarily formed from the end of the roofing membrane. The flashing is defined by bending the membrane to form a flap which may be a few inches in width. The flap is then heated with a torch and urged against the projecting side surface by means of a trowel to bond the roofing material to the side surface. The manipulation of the flap has often resulted in the installer receiving burns on the hand which holds the flap while it is being heated.

SUMMARY OF THE INVENTION

The present invention overcomes the above-discussed and other deficiencies of the prior art by providing a new and improved tool which is especially well suited to use in the formation and installation of a flashing formed from the roofing materials of conventional torch-fused roofing systems.

Briefly stated, the invention in a preferred form is a roofing tool which is employed to both function as a trowel for sealing the joints between strips of roofing membrane and as a grasping tool for bending the roofing material to form a flap and to hold that flap during heating with an open flame. The roofing tool comprises a trowel blade having opposing forward and rear ends and an intermediate portion. The forward end of the blade tapers to a rounded tip configuration. The trowel blade preferably increases in width from the rear end to the intermediate portion and decreases in width from the intermediate portion to the rounded tip. A shank is connected to the rear portion of the trowel blade and extends generally away from the plane of the blade. A handle is connected to the shank. The handle preferably extends obliquely from the shank and generally in a rearward direction relative to the blade. A pivot shaft is mounted in fixed relationship to the shank and spaced from the trowel blade. The shaft has an axis which is oriented so as to be generally parallel to the plane of the trowel blade. A clamp arm is pivotally supported from the shaft. The clamp arm extends both forwardly, i.e., toward the blade, and rearwardly of the shaft. A clamp plate having a flat side is affixed to the forward end of the clamp arm so as to overlie the tip portion of the blade. The clamp arm is configured such that the clamp plate flat side and the trowel blade may be positioned parallel to one another. The clamp arm is further configured so that when a sheet of roofing material is inserted between the clamp plate and the trowel blade, the handle and the rearly extending portion of the clamp arm may be manually squeezed together to clamp the roofing material between the clamp plate flat side and the upper surface of the trowel blade.

At least the gripping region of the rearwardly extending portion of the clamp arm is provided with a protective covering. This protective covering and the trowel handle are formed from materials which have low coefficients of thermal conductivity. The clamp arm is preferably formed from a metal rod. The clamp plate comprises a member which is affixed to the clamp arm and at least a portion of the clamp plate has an arcuate shape which is coaxial with and in registration with the rounded tip of the trowel blade. The rearwardly extending portion of the clamp arm preferably has a C-shaped configuration to facilitate manual grasping and manipulation of the clamp arm.

An object of the invention is to provide a new and improved tool suitable for use in the installation of a membrane roofing system.

Another object of the invention is to provide a new and improved roofing tool which may be efficiently employed both for trowelling the roofing membrane for forming the seams of a torch-fused roofing system and for graeping the end of a roofing membrane for heating the said end.

A further object of the invention is to provide a new and improved roofing tool which facilitates the formation of a flashing and the fusing of the flashing to a surface projecting from a roof.

Yet another object of the invention is to provide a new and improved roofing tool of efficient and compact construction which is capable of one-hand use for grasping the edge of a roofing membrane during torching the membrane edge, the tool being subsequently usable for urging the heated membrane into the desired position.

Other objects and advantages of the invention will become apparent from the specification and the drawing.

DETAILED DESCRIPTION OF THE INVENTION

Figure 1:
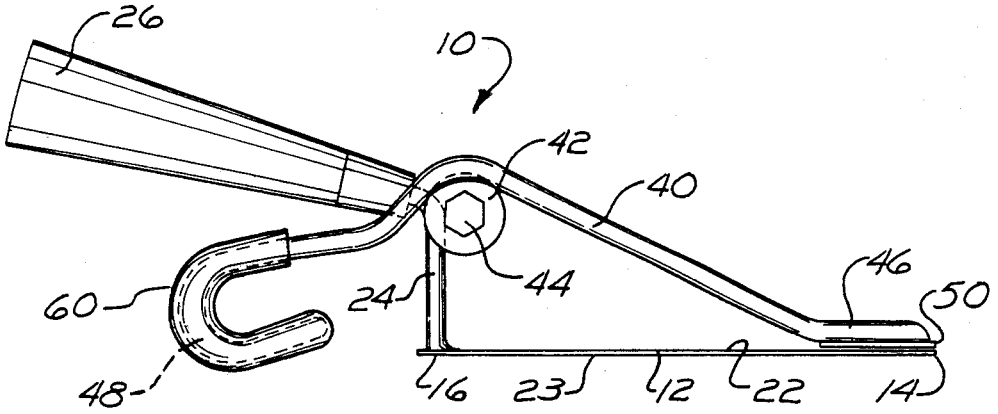
FIG. 1 is a side elevational view, partly in phantom, of a roofing tool in accordance with the present invention.

With reference to the drawing wherein like numerals represent like parts in the two figures, a roofing tool in accordance with the present invention is generally designated by the numeral 10. Roofing tool 10 in its preferred application is employed as a trowel for use in torch-fusing overlapping seams of a roofing membrane and also as a tool for grasping the end of a roofing membrane so that the membrane end may be formed into a flashing, torched and subsequently bonded to a structure projecting from a roof surface. The roofing tool 10 is relatively lightweight and of rugged construction. The roofing tool is also dimensioned to permit one-hand use by a roof installer who grasps and manipulates the tool while directing a torch with the other hand.

Roofing tool 10 comprises a metal trowel blade 12 which may be of a conventional form employed in installing roofing systems except for the front end or tip 14 of the blade. Tip 14 is rounded as shown. The blade 12 has a generally uniform thickness and is symmetrical relative to a central axis extending from the tip 14 to an opposing rear portion 16 of the blade. An intermediate portion of the trowel blade, defined by side edge apexes 18 and 20, has the maximum width. The blade width gradually tapers symmetrically from apexes 18 and 20 to the rounded tip 14. The blade 12 also tapers rearwardly from apexes 16 and 18 to rear portion 16. At least the lower surface 23 of the blade 12 is preferably smooth.

A shank 24 formed from a metal rod projects from the upper surface 22 of rear portion 16 of blade 12 in a direction which, in the disclosed embodiment, is generally transverse to the plane of the blade. Shank 24 is preferably bent at an oblique angle so that the end thereof disposed away from blade 12 extends upwardly at an angle and in a direction which is away from blade 12. A handle 26 is affixed to the extension of shank 24 as shown. Handle 26 is comprised of a material having a low coefficient of thermal conductivity, wood for example, and extends generally rearwardly away from the trowel blade at an acute angle to the plane of the trowel blade as best illustrated in FIG. 1.

A boss 30 is welded to shank 24 and projects generally forwardly from the shank at an upper location proximate the bend of the shank. Boss 30 forms a generally transversely extending aperture for receiving a pivot shaft 32. Pivot shaft 32 may be in the form of a bolt 34 as illustrated or may be a pivot pin of conventional form. Shaft 32 extends in a generally transverse direction and defines a pivot axis which is generally parallel to the plane of the trowel blade 12 and perpendicular to the shank section extending between the blade 12 and the boss 30.

A clamp arm 40 is formed from a metal rod which is bent to the configuration illustrated in the drawing. An apertured mounting member 42 is welded to the clamp arm 40 at an intermediate bend in the arm. Shaft 32 slidably passes through member 42 whereby pivotal movement of the clamp arm about the axis of shaft 32 is pemitted. A lock nut 44 may be threaded and/or welded to shaft 32 to secure the clamp arm to the shaft. As an alternative construction, member 42 may be formed integrally with arm 40. As a further alternative, the clamp arm may be pivotally coupled to shank 24 in a manner which permits easy removal thereof.

Figure 2:
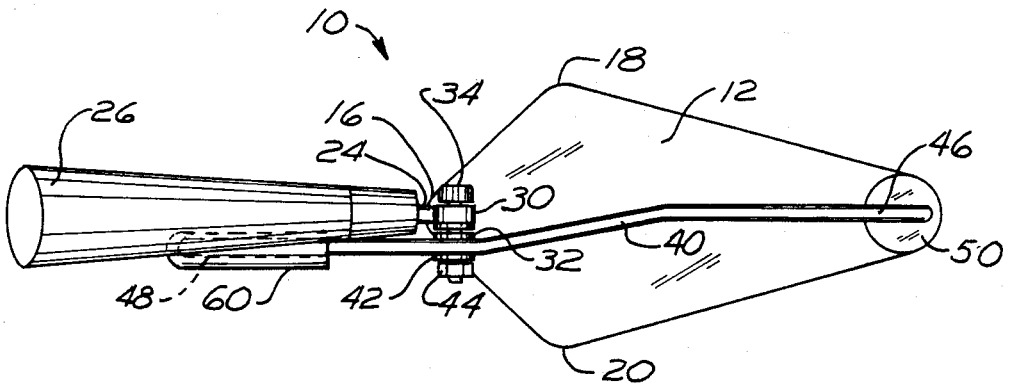
FIG. 2 is top plan view, partly in phantom, of the roofing tool of FIG. 2.

The forward end 46 of arm 40 is slightly angled relative to the adjoining arm portion as shown. A clamp plate 50 is affixed to end 46 of arm 40. Clamp plate 50 may be generally in the form of a washer or similar member having a lower surface which defines a plane. Clamp plate 50 is welded to the clamp arm forward end. The front edge of the clamp plate is sized and shaped so as to be capable of substantial alignment with the rounded tip 14 of the trowel blade when arm 40 has been pivoted so as to place the lower surface of the clamp plate 50 adjacent to and in a generally parallel relationship with the upper blade surface 22. The arm 40 is provided with a slight bend as illustrated in FIG. 2 to accommodate the offset pivotal mounting of the clamp arm.

Arm 40 is also bent so that the rearwardly extending portion thereof forms a lever handle 48. The lever handle 48 may have a C-shaped configuration as shown so that the handle 24 may be grasped in one hand by a roof installer with fingers of the hand engaging the lever hancle 48 for pivotal manipulation of the clamp arm. The lever handle 48 is further configured so that the handle portion remote from the pivotal connection is spaced from the wooden handle 26. The handle 48 is at least partly covered with a sleeve 60 of thermal insulating material.

The roofing tool 10 may be employed in the conventional manner with blade 12 functioning as a trowel during the fusing of the overlapping seams of the roofing material. The roofing tool 10, however, may also be employed as a tong or holding tool. When used as a holding tool, the end of a sheet of roofing membrane (not illustrated) will be inserted between the clamp plate 48 and the upper surface 22 of the trowel blade 12. The roof installer may thus clamp the end of the roofing material by compressively grasping the lever handle 48 and the trowel handle 26. The end of the roofing material may be heated by a propane torch which is held in the other hand of the installer. The roofing tool functions to hold the roofing material in position during the torching process thus protecting the fingers and hands of the installer. In addition, the rounded cooperating surfaces of the clamp plate 50 and the tip of the trowel blade may be employed to bend the roofing material to form a flap or a flashing. After torching the end portion of the roofing material while it is held by the tool, the clasped roofing flap will be positioned against a side surface which projects from the roof. The bottom surface 20 of the trowel blade may then be employed to press the heated roofing material against the side surface whereby the softened roofing material will adhesively bond to the side surface. It should be appreciated that handles 26 and 48 are thermally insulated so that the torching of the end of the roofing material does not produce a corresponding high temperature at the hand grasping portions of the roofing tool. The roofing tool is of a relatively lightweight and compact configuration which, of course, facilitates its use, particularly the ability to hold the tool in one hand while the roofing material is grasped in tong-like fashion and the other hand is free to operate the open flame torch.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A roofing tool comprising:

a trowel blade, said blade defining a plane and having oppositely disposed forward and rear portions, said forward portion terminating at a forward edge with a rounded configurarion.

a shank connected to the rear portion of said blade and extending generally away from said blade defined plane;

trowel handle means mounted on said shank, said trowel handle means extending generally rearwardly relative to said blade; and clamp means, said clamp means including a clamp arm having opposing forward and rear portions and an intermediate portion therebetween, said clamp means also including means for pivotally mounting said clamp arm on said shank at said intermediate portion, said clamp means also including a clamp plate affixed to the free end of said clamp arm forward portion, said clamp plate having a surface which defines a plane, said clamp arm being pivotable to establish a generally parallel relationship between said clamp plate and trowel blade defined planes, the rear portion of the clamp arm being in the form of a lever handle, said arm rear portion being spaced from and extending along at least a portion of the length of said trowel handle so that when an end of a sheet of roofing material is positioned between the clamp plate and the trowel blade, the trowel handle and rear portion of the clamp arm may be manually compessively grasped to pivotally force the clamp plate and trowel blade into clamping engagement with the roofing material sheet for holding the sheet.

2. The roofing tool of claim 1 wherein said trowel handle means is in part formed of a material which has a low coefficient of thermal conductivity and at least a portion of said clamp arm rear portion is provided with a covering of a material having a low coefficient of thermal conductivity.

3. The roofing tool of claim 1 wherein said clamp arm is formed from a metal rod and said clamp plate comprises a member affixed to an end of said rod.

4. The roofing tool of claim 1 wherein said clamp arm rear portion in part has a generally C-shaped configuration.

5. The roofing tool of claim 1 wherein said clamp plate has at least a partly rounded configuration and the rounded forward end of said blade is generally coaxial with and in alignment with said rounded clamp plate part when said planes are parallel.

6. The roofing tool of claim 1 wherein said clamp means pivotal mounting means includes a shaft mounted in fixed relationship with said shank, said shaft having an axis generally parallel to the plane of said blade.

7. The roofing tool of claim 3 wherein said clamp plate has at least a partly rounded configuration and the rounded forward end of said blade is generally coaxial with and in alignment with said rounded clamp plate part when said planes are parallel.

8. The roofing tool of claim 7 wherein said trowel handle means is in part formed of a material which has a low coefficient of thermal conductivity and at least a portion of said clamp arm rear portion is provided with a covering of a material having a low coefficient of thermal conductivity.

9. The roofing tool of claim 8 wherein said clamp arm rear portion in part has a generally C-shaped configuration.

* * * * *